US005983534A

United States Patent [19]

Robinson et al.

[11] Patent Number: 5,983,534

[45] Date of Patent: Nov. 16, 1999

[54] ROTARY LOCK SYSTEM FOR EXCAVATING TOOTH/ADAPTER ASSEMBLY

[75] Inventors: Howard W. Robinson, Grapevine; Paul G. Jusselin, Irving, both of Tex.

[73] Assignee: G. H. Hensley Industries, Inc., Dallas, Tex.

[21] Appl. No.: 08/932,251

[22] Filed: Sep. 17, 1997

[51] Int. Cl.[6] ..... E02F 9/28

[52] U.S. Cl. ..... 37/459; 37/452

[58] Field of Search ..... 37/455–458, 446, 37/450, 452, 453, 454; 403/379, 374; 172/753

[56] References Cited

U.S. PATENT DOCUMENTS

| | | | |
|---|---|---|---|
| 943,775 | 12/1909 | Exton et al. | 37/455 X |
| 1,202,806 | 10/1916 | Clark, Jr. . | |
| 1,729,889 | 10/1929 | McNinch . | |
| 1,808,311 | 6/1931 | Madonna | 37/456 |
| 2,167,425 | 7/1939 | Page | 37/142 |
| 2,312,802 | 3/1943 | Crawford | 37/142 |
| 2,618,873 | 11/1952 | Hosteter | 37/142 |
| 2,635,366 | 4/1953 | Hostetter | 37/142 |
| 3,608,218 | 9/1971 | Sturgeon | 37/142 A |
| 3,762,079 | 10/1973 | Lukavich et al. | 37/141 R |
| 3,904,247 | 9/1975 | Ostrop | 37/456 X |
| 4,056,893 | 11/1977 | Willard | 37/142 R |
| 4,067,657 | 1/1978 | Kaarlela | 403/317 |
| 4,626,034 | 12/1986 | Breuer et al. | 37/458 X |
| 4,663,867 | 5/1987 | Hahn et al. | 37/142 R |
| 4,761,900 | 8/1988 | Emrich | 37/142 R |
| 5,233,770 | 8/1993 | Robinson | 37/456 |
| 5,410,826 | 5/1995 | Immel et al. | 37/455 X |
| 5,435,084 | 7/1995 | Immel | 37/398 |
| 5,452,529 | 9/1995 | Neuenfeldt et al. | 37/455 |
| 5,491,915 | 2/1996 | Robinson | 37/458 |
| 5,638,621 | 6/1997 | Keech et al. | 37/455 X |
| 5,666,748 | 9/1997 | Emrich et al. | 37/455 X |

FOREIGN PATENT DOCUMENTS

| | | | |
|---|---|---|---|
| 289075 | 4/1991 | Germany | 37/457 |

*Primary Examiner*—Victor Batson
*Attorney, Agent, or Firm*—Konneker & Smith, P.C.

[57] ABSTRACT

An excavating tooth point is captively retained externally on an adapter nose with a specially designed lock structure removably received in a side wall opening of the tooth point and an underlying opening in the adapter nose. The rotary lock structure includes a cylindrical body having a side portion from which a resiliently biased force exerting member and a spring-loaded detent pin outwardly project. With the adapter nose received in the tooth pocket the lock structure body is axially inserted into the tooth and adapter openings in a first rotational orientation and then forcibly rotated to a second rotational orientation. The surfaces of the tooth and nose openings are configured to radially inwardly displace the radially outwardly biased force exerting member in response to such rotation, in a manner causing the force exerting member and the lock structure body to exert on the adapter nose and tooth point a continuous resilient force tending to tighten the tooth point onto the adapter nose. As the lock structure is rotated during its installation, a ramped surface on the adapter nose cams the detent pin inwardly and then permits it to snap into a retaining pocket on the nose to thereby releasably prevent further rotation of the lock structure. The inserted lock structure may subsequently be removed by axially or rotationally driving it to shear the detent pin or using a sloping face of the retaining pocket to cam the detent pin into the lock structure body.

31 Claims, 8 Drawing Sheets

ROTARY LOCK SYSTEM FOR EXCAVATING TOOTH/ADAPTER ASSEMBLY

BACKGROUND OF THE INVENTION

The present invention generally relates to material displacement apparatus and, in a preferred embodiment thereof, more particularly relates to a specially designed rotary lock structure for releasably holding a replaceable earth excavating tooth point on a nose portion of an associated adapter structure.

A variety of types of material displacement apparatus, such as earth working structures, are typically provided with replaceable portions that are removably carried by larger base structures and come into abrasive wearing contact with the material being displaced. For example, excavating tooth assemblies provided on digging such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. The removability of the tooth point advantageously permits the more massive adapter to have a substantially longer operating life than if the point was an integral portion thereof.

To captively retain the tooth point on the adapter nose, aligned transverse openings are formed through these interengageable elements adjacent the rear end of the point, and a suitable connector structure is forcibly driven into and retained within the openings to releasably anchor the replaceable tooth point on its associated adapter nose portion. These connector structures adapted to be driven into the aligned tooth point and adapter nose openings typically come in two primary forms—(1) wedge and spool connector sets, and (2) flex pin connectors.

A wedge and spool connector set comprises a tapered spool portion which is initially placed in the aligned tooth and adapter openings, and a tapered wedge portion which is subsequently driven into the openings, against he spool portion, to jam the structure in place within the openings in a manner exerting high rigid retention forces on he interior opening surfaces and press the nose portion into a tight fitting engagement with the interior surface of the tooth socket.

Very high drive-in and knock-out forces are required to insert and later remove the steel wedge and typically require a two man effort to pound the wedge in and out—one man holding a removal tool against an end of the wedge, and the other man pounding on the removal tool with a sledge hammer. The drive-in and knock-out forces, of course, increase with the size of the tooth/adapter nose assembly involved. This creates a safety hazard due to the possibility of flying metal slivers and/or the second man hitting the first man instead of the removal tool with the sledge hammer. Additionally, wear between the tooth/adapter nose assembly surface interface during excavation use of the tooth tends to loosen the original tight fit of the wedge/spool structure within the tooth and adapter nose openings, thereby permitting the wedge/spool structure to fall out of the openings and thus permitting the tooth to fall off the adapter nose.

Flex pin connector structures, on the other hand, typically comprise two elongated metal members held in a spaced apart, side-by-side orientation by an elastomeric material bonded therebetween. The flex pin structure must be longitudinally driven into the tooth and adapter nose openings to cause the elastomeric material to be compressed and resiliently force the metal members against the nose and tooth opening surfaces to retain the connector structure in place within the openings and resiliently press the adapter nose portion into tight fitting engagement with the interior surface of the tooth socket. This creates essentially the same potential safety hazards as arise when a metal wedge member is being driven into the tooth and adapter nose openings as previously described herein. Subsequently, of course, the flex pin structure must be pounded out of the tooth and adapter openings.

Conventionally constructed flex pin structures also have other disadvantages and limitations. For example, compared to wedge/spool structures they have a substantially lower in-place retention force. This is due to the fact that the elastomeric flex pin portion, as the flex pin is being driven into place within the tooth/adapter nose assembly, must be compressed more than when it reaches its installed position within the assembly. Thus, the elastomeric element partially "relaxes" when it reaches its installed position and cannot exert its full available resilient retention force on the tooth and adapter nose surfaces.

Moreover, in conventionally configured flex pin structures, the retention of the flex pin structure within the tooth/adapter nose assembly is dependent upon maintaining a certain minimum resilient force by the elastomeric element on an interior surface portion of the tooth/adapter nose assembly. When internal assembly surface wear progresses to a certain point the connector can fall out because this resilient force is no longer large enough. It can be seen from the foregoing that it would be desirable to provide improved excavating tooth connector apparatus that eliminates or at least substantially reduces the above-mentioned problems, limitations and disadvantages commonly associated with conventional excavating tooth and other material displacement equipment connector apparatus of the general type described above. It is accordingly an object of the present invention to provide such improved connector apparatus.

SUMMARY OF THE INVENTION

In carrying out principles of the present invention, in accordance with a preferred embodiment thereof, improved earth working tooth and adapter apparatus is provided for use on an earth working structure such as an excavating bucket. The improved apparatus includes a replaceable tooth point having a pocket area, an outer wall, and a first opening extending through the outer wall into the pocket area and having a side surface; and an adapter having a forwardly projecting nose portion with a second opening extending therethrough and having a side surface, the nose portion being removably insertable into the tooth point pocket area in a manner causing the second opening to underlie the first opening in the tooth point.

To releasably retain the replaceable tooth point on the adapter nose, a specially designed rotary lock structure is provided. The lock structure has a resiliently deflectable force exerting portion and, with the nose portion inserted into the tooth point pocket area, is insertable along an insertion axis into the first and second openings in a first rotational orientation and then rotated about the insertion axis to a second rotational orientation.

According to a key feature of the invention, the side surfaces of the first and second openings are configured to resiliently deflect the force exerting member, in a manner causing the rotary lock structure to exert on the adapter nose portion and the tooth point a resilient force tending to tighten the tooth point rearwardly onto the nose portion, in response to movement of the rotary lock structure from its first rotational orientation to its second rotational orientation within the first and second openings.

In its preferred embodiment, the rotary lock structure includes a generally cylindrical body portion having a side surface recess formed therein, a force exerting member movably received in the side surface recess, and first resilient means for resiliently biasing the force exerting member outwardly through the side surface recess. An opening extends radially through the body portion and movably receives a detent member movably received in the opening. Second resilient means are provided for resiliently biasing the detent member outwardly through the opening.

The earth working tooth and adapter apparatus also preferably includes structure associated with the adapter nose for cooperating with the detent member to releasably prevent the inserted rotary lock structure from rotating from its second rotational orientation back to its first rotational orientation. Representatively, such structure includes a depression formed in the adapter nose and having a ramped surface adjacent a detent pocket formed in the adapter nose. As the inserted lock structure is rotated from its first rotational orientation to its second rotational orientation the ramped surface inwardly cams the detent member into its associated lock structure body opening, and then permits the retracted detent member to snap outwardly into the adapter nose detent pocket.

In one embodiment of the tooth and adapter apparatus the detent member is of a shearable construction and may be broken, to permit removal of the installed rotary lock structure, by forcibly moving the lock structure relative to the balance of the apparatus. In other embodiments of the tooth and adapter apparatus the adapter nose detent pocket is provided with sloping side surfaces which cams the detent member out of the detent pocket when the installed lock structure is forcibly driven axially or rotationally relative to the balance of the tooth and adapter apparatus.

DETAILED DESCRIPTION

Figure 1:
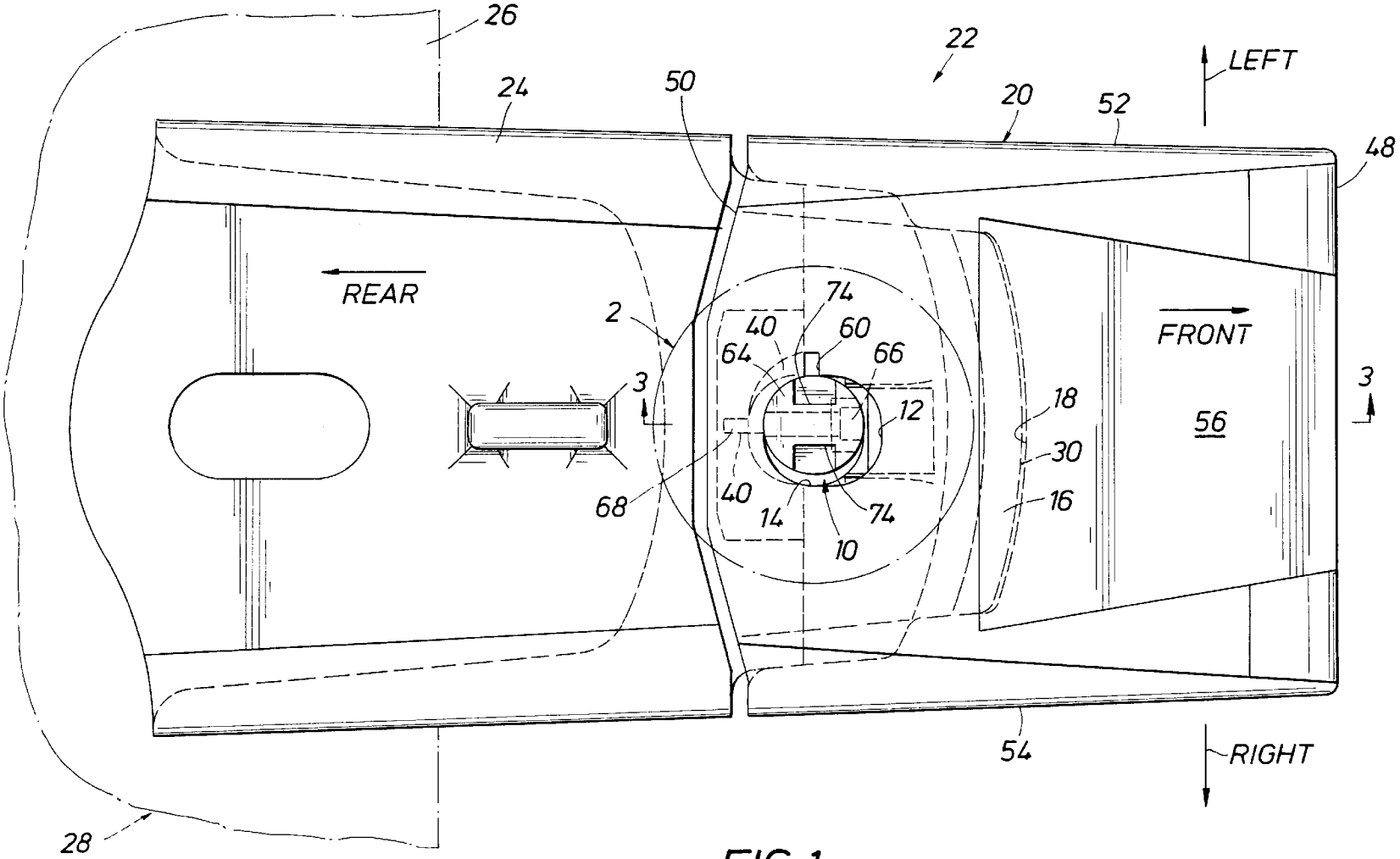
FIG. 1 is a top side view of an earth working excavating tooth/adapter assembly in which a replaceable tooth point is removably held in place on an adapter nose portion using a specially designed rotary lock system embodying principles of the present invention.

Referring initially to FIGS. 1, 3, 4 and 5, the present invention provides a specially designed rotary lock structure 10 which is extended into generally aligned tooth and adapter nose openings 12,14 to releasably retain an adapter nose portion 16 within the tapered socket 18 of a replaceable excavating tooth point 20 in a tooth/adapter assembly 22. The adapter nose 16 is a forwardly projecting portion of a larger adapter body 24 secured to a portion of an earth working structure such as, for example, the lower front edge portion 26 of the excavating bucket 28 partially illustrated in phantom in FIG. 1.

Figure 3:
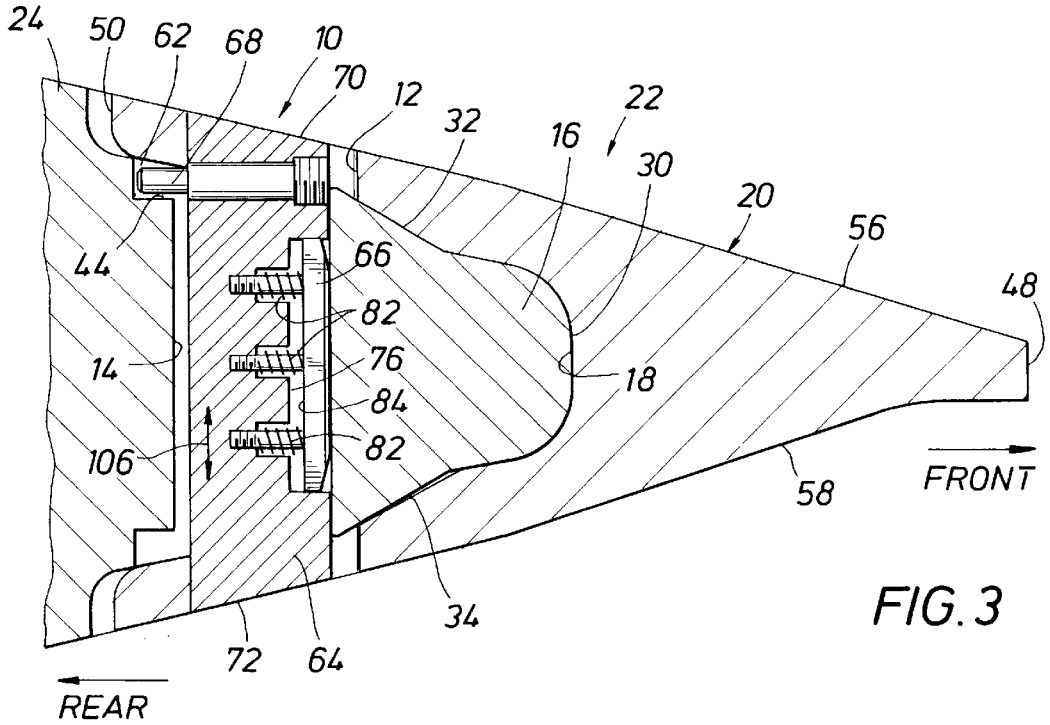
FIG. 3 is an enlarged scale, somewhat simplified cross-sectional view through the assembly taken along line 3—3 of FIG. 1.
Figure 4A:
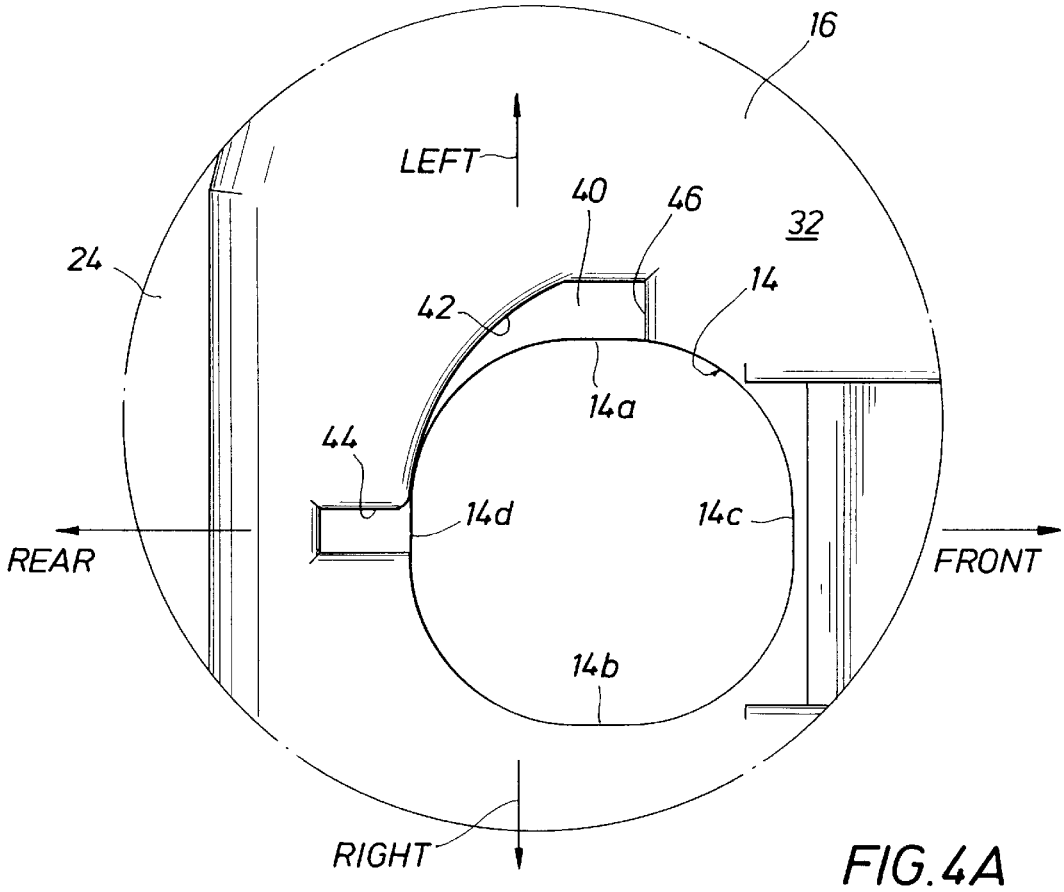
FIG. 4A is an enlargement of the dashed circle area "4A" in FIG. 4.

Turning now to FIGS. 1 and 3–4A, the adapter nose 16 has a front end 30, opposite top and bottom sides 32 and 34 between which the opening 14 extends, and opposite left and right sides 36 and 38. Representatively, as best illustrated in FIG. 4A, the adapter nose opening 14 has an arcuate but noncircular configuration, being of a generally ovoid shape with somewhat flattened opposite left and right side surface portions 14*a*,14*b* and somewhat flattened opposite front and rear side surface portions 14*c*, 14*d*.

For purposes later described herein, a depression 40 is formed in the top side 32 of the adapter nose 16 adjacent the periphery of the opening 14 and extending through a circumferential arc of approximately ninety degrees. The depression 40 has an outer side wall portion 42 which is circumferentially ramped relative to the opening 14, progressively sloping radially inwardly in a counterclockwise direction as viewed in FIG. 4A. The radially innermost end of the outer side wall portion 42 is adjacent a radially outwardly extending, generally rectangular pocket portion 44 of the depression 40, while at the radially outermost end of the wall 42 is a generally rectangular entry portion 46 of the depression 40.

Figure 5:
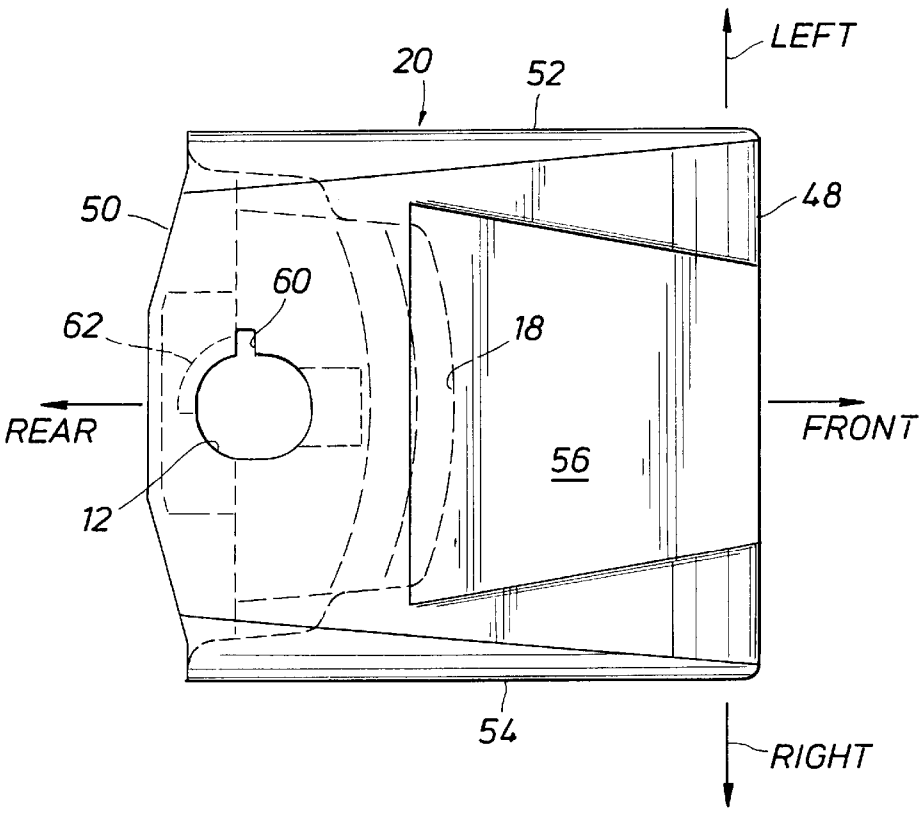
FIG. 5 is a reduced scale top side view of the tooth point removed from the adapter nose.
Figure 4:
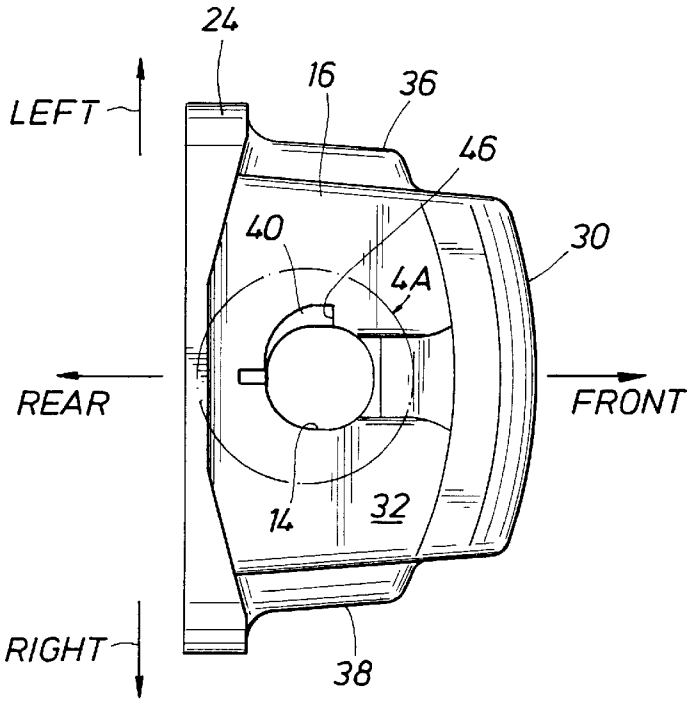
FIG. 4 is a reduced scale top side view of the adapter with the tooth point removed therefrom.

Tooth point 20, as best illustrated in FIGS. 1, 3 and 5, has a front end 48, a rear end 50 through which the pocket area 18 rearwardly opens, opposite left and right side walls 52 and 54, and opposite top and bottom side walls 56 and 58 through which the opening 12 extends into the interior of the pocket area 18. For purposes later described herein, the portion of the opening 12 that extends inwardly through the top side wall 56 has a generally rectangular radially outwardly extending portion 60. When the adapter nose 16 is received in the tooth pocket 18 the radially outwardly extending tooth opening portion 60 directly overlies the entry portion 46 of the adapter nose top side wall recess 40 (see FIG. 8). Formed in the inner side surface of the top wall 54 is an arcuate recess 62 (see FIGS. 3 and 5) which, with the adapter nose 16 received in the tooth point pocket 18, generally overlies the adapter nose recess 40 and forms an upward extension thereof.

Figure 6:
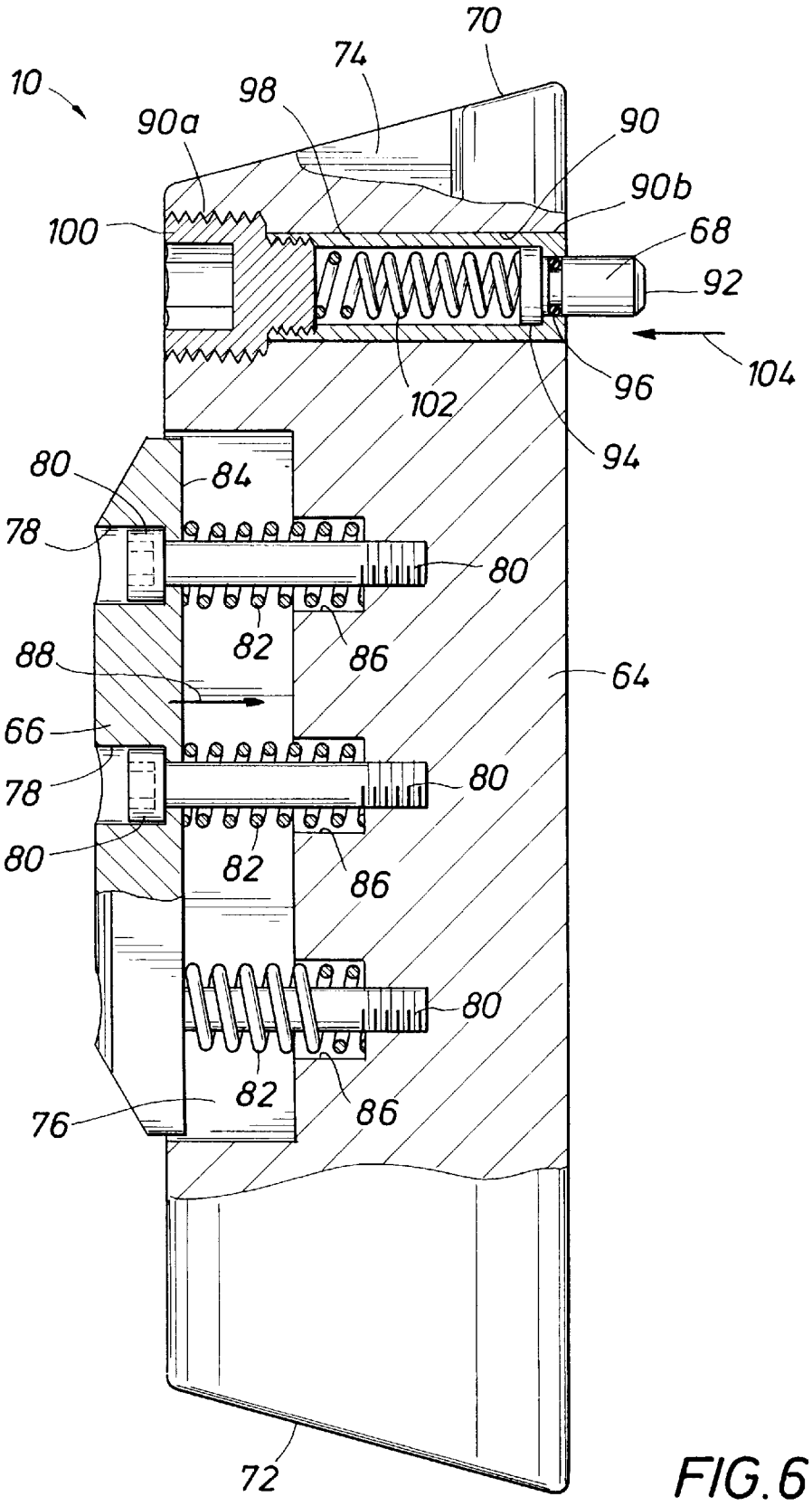
FIG. 6 is an enlarged scale partially cut away side elevational view of a rotary lock structure removed from the assembly.
Figure 7:
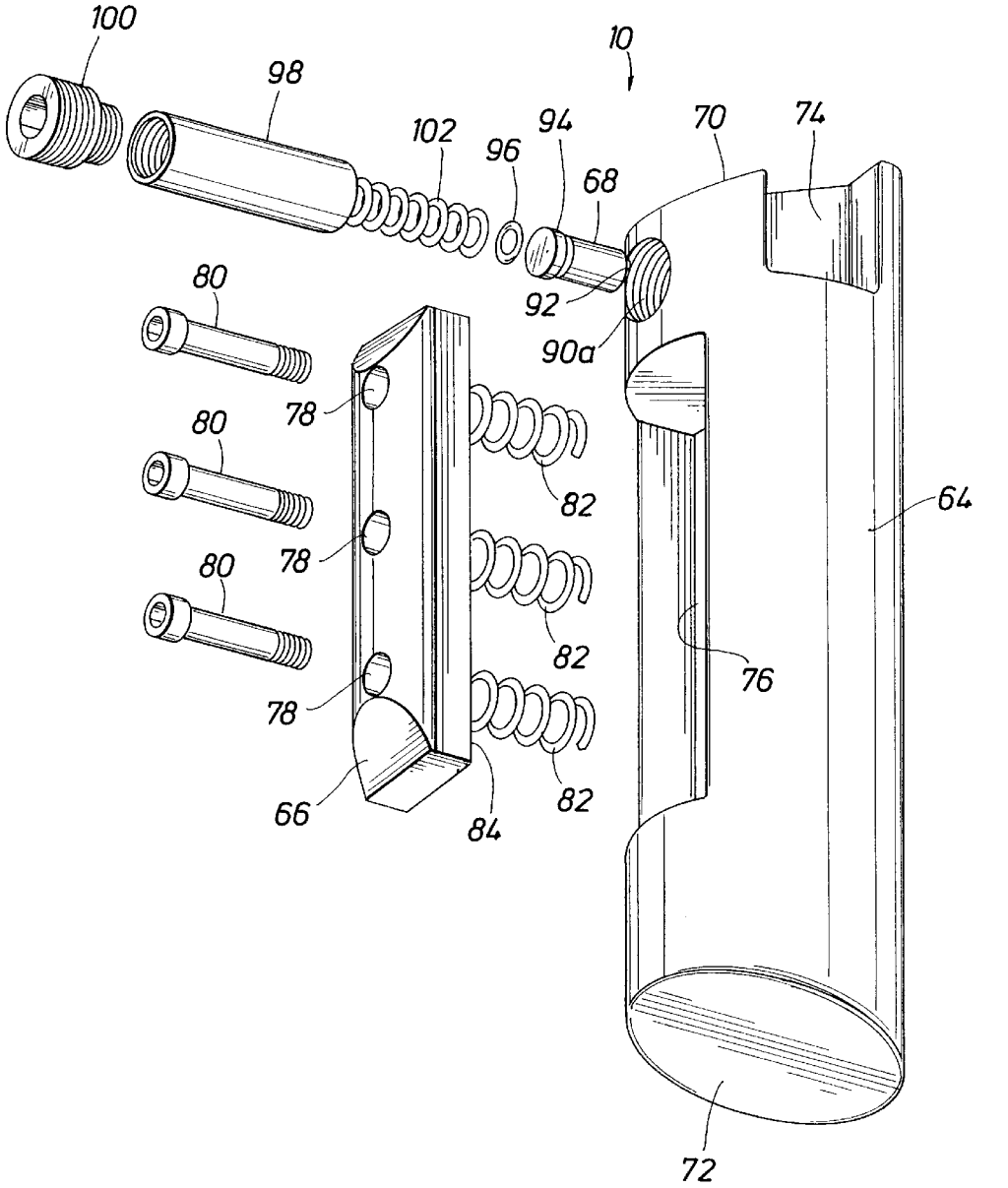
FIG. 7 is an exploded perspective view of the rotary lock structure.

With reference now to FIGS. 6 and 7, the rotary lock structure 10 includes (1) a cylindrical metal body 64, (2) an elongated rectangular metal force exerting member 66, and (3) a cylindrical metal detent member 68. Body 64 has oppositely sloping upper and lower end surfaces 70 and 72, a diametrically opposite pair of radially inwardly extending side surfaces recesses 74 at its upper end, and an axially elongated rectangular side surface recess 76 positioned below and circumferentially between the upper end recesses and configured to slidingly receive the force exerting member 66 as later described herein.

The force exerting member 66 has three longitudinally spaced, countersunk circular bores 78 extending therethrough and configured to slidingly receive three elongated cap screws 80. Screws 80 extend through three coil spring members 82 which underlie the force exerting member 66 and are positioned within the recess 76. As best illustrated in FIG. 6, the springs 82 bear at their outer ends against the underside 84 of the force exerting member 66, with inner end portions of the springs 82 being received in countersunk circular bores 86 which extend inwardly through the inner side surface of the body side surface recess 76. The inner ends of the screws 80 are threaded into the reduced diameter inner end portions of the bores 86 as illustrated in FIG. 6.

Accordingly, the force exerting member 66 is resiliently biased outwardly through the side surface recess 76 to its relaxed position shown in FIG. 6 by the springs 82. To provide such outward biasing another type of resilient structure, such as an elastomeric material, could be used in place of the springs 82. Upon receiving a laterally inwardly directed force, the member 66 is displaced into the recess 76, against the resilient resistance force of the springs 82, as indicated by the arrow 88 in FIG. 6.

A circular bore 90 extends transversely through an upper end portion of the lock structure body 64, between its upper end recesses 74, and has an enlarged, threaded outer end portion 90*a* on the same side of the body as the recess 76, and a countersunk inner end portion 90*b* on the side of the body 64 opposite from the recess 76. The cylindrical detent member 68 has a chamfered outer end 92, and a radially enlarged outer end 94, extends through a resilient O-ring seal member 96, is slidably received in the bore 90, and projects outwardly through the inner end of the bore 90 (see FIG. 6) with the enlarged inner end 94 of the detent member 68 preventing the detent member 68 from passing outwardly through the counterbored inner end 90*b* of the bore 90.

A tubular spring guide member 98 is coaxially received within the bore 90 and has a threaded plug member 100 threaded into its outer end and also threaded into the enlarged outer end portion 90*a* of the bore 90. An elongated coiled compression spring member 102 is received within the spring guide member 98. Spring 102 bears at one end against the inner end of the plug member 100, and at its other end against the enlarged detent member end portion 94, and resiliently biases the detent member 68 to its radially outwardly extended normal position shown in FIG. 6. A radially inwardly directed force on the detent member 68 moves the detent member 68 inwardly into the bore 90, against the resilient resistance force of the spring 102, as indicated by the arrow 104 in FIG. 6.

Figure 8:
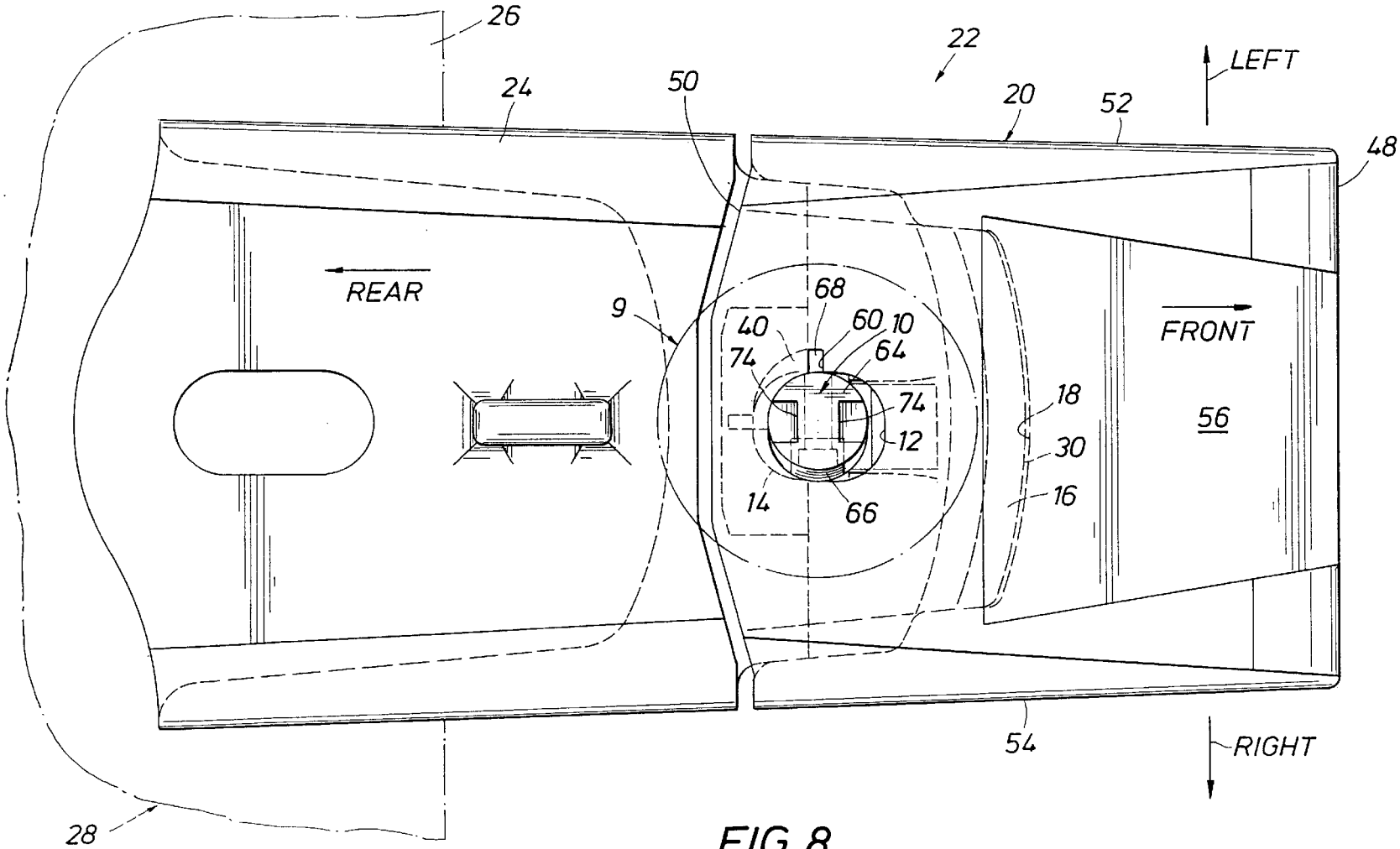
FIG. 8 is a top side view of the excavating tooth/adapter assembly prior to a rotational tightening of the rotary lock structure therein.
Figure 9:
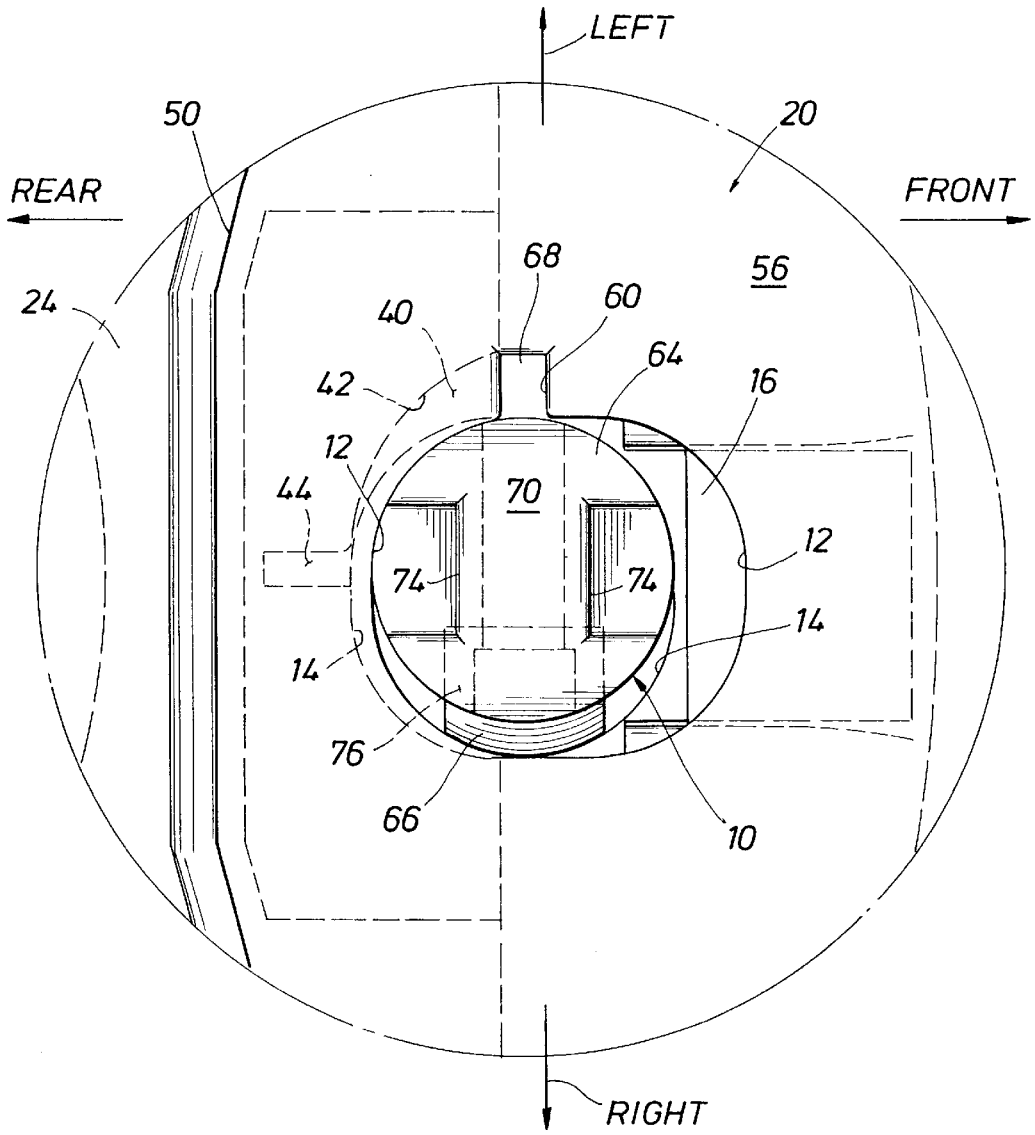
FIG. 9 is an enlargement of a portion of the dashed circle area "9" in FIG. 8.

Turning now to FIGS. 8 and 9, to removably install the tooth point 20 on the adapter nose 16, the nose 16 is first inserted forwardly into the pocket area 18 of the tooth point 20 in a manner bringing the portion of the tooth opening 12 in the top tooth wall 56 into an overlying relationship with the adapter nose opening 14 as may be best seen in FIG. 9. It should be noted that, with the tooth 20 placed on the adapter nose 16 in this manner, the tooth and adapter nose openings 12,14 are relatively configured and arranged in a manner such that they are generally aligned in a left-to-right direction, but are laterally offset from one another in a front-to-rear direction.

More specifically, a rear side surface portion of the tooth opening 12 is forwardly offset from a corresponding rear side surface portion of the underlying adapter nose opening 14, and a front side surface portion of the tooth opening 12 is forwardly offset from a corresponding front side surface portion of the underlying adapter nose opening 14. The somewhat ovoid tooth opening 12 is preferably elongated in a front-to-rear direction so that the front-to-rear offset between the corresponding front side surface portions of the openings 12,14 is greater than the front-to-rear offset between their corresponding rear side surface portions. This provides a built-in tolerance that keeps the front side surface portion of the tooth point opening 12 from interfering with lock structure installation when the tooth moves further back on the adapter nose due to wear on the adapter nose. Additionally, as can be best seen in FIG. 9, the distance between the aligned left and right side surface portions of the openings 12,14 is greater than the front-to-rear distance between the rear side surface portion of the tooth opening 12 and the front side surface portion of the adapter nose opening 14. The distance between the aligned left and right side surface portions of the openings 12,14 defines in the combined opening means 12,14 a minimum lock structure insertion width which extends generally transversely to the insertion axis and to the front-to-rear direction of the assembly 22.

Still referring to FIGS. 8 and 9, with the tooth point 20 positioned on the adapter nose 16 as shown, the previously described rotary lock structure 10 is installed in the tooth and adapter nose openings 12,14 as follows. With its top end up and its outwardly projecting detent member 68 facing leftwardly as viewed in FIGS. 8 and 9, the rotary lock structure body 64 is axially inserted downwardly into the openings 12,14 (along an insertion axis which is the longitudinal axis of the body 64) so that the detent member 68 passes downwardly through the radially outwardly projecting portion 60 of the tooth opening 12 and enters the underlying adapter nose top side recess portion 46 (see FIG. 4A) and the outwardly projecting force exerting member portion 66 of the inserted rotary lock structure 10 is contiguous with the right side surface portion of the adapter nose opening 14.

Figure 2:
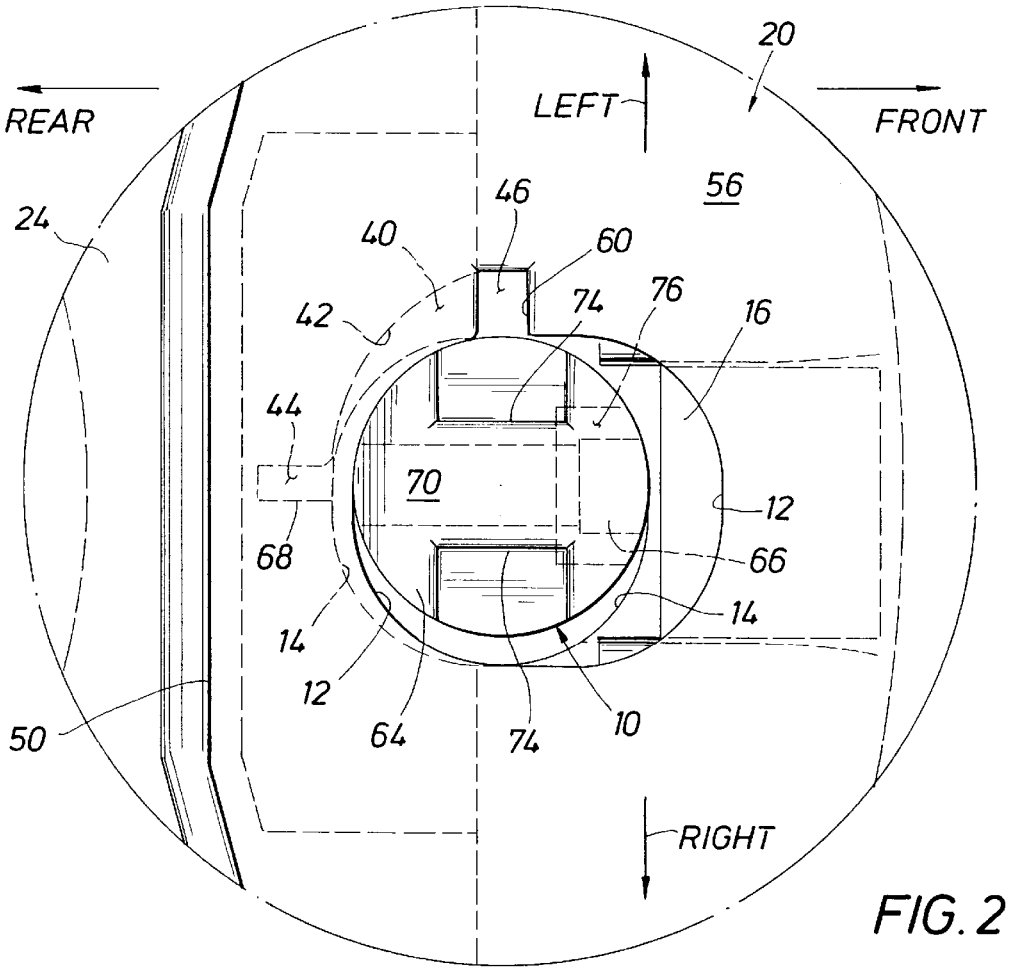
FIG. 2 is an enlargement a portion of the dashed circle area "2" in FIG. 1.

Next, using an appropriate torquing tool (not shown) having portions inserted into the upper end recesses 74 of the lock body 64, the inserted lock structure 10 is forcibly rotated in a counterclockwise direction from its initially inserted position shown in FIGS. 8 and 9 through ninety degrees relative to the balance of the assembly 22 to its finally installed position shown in FIGS. 1 and 2. During such forcible rotation of the inserted lock structure two things occur.

First, as the lock structure 10 is rotated, because of the relative positions and configurations of the openings 12 and 14, the initially outwardly projecting force exerting member 66 (see FIG. 9) is brought into engagement with the front side surface portion of the adapter nose opening 14 which serves to rearwardly push the force exerting member 66 into the lock structure body side recess 76, against the resilient resistance force of the force exerting member springs 82 (see FIGS. 6 and 7). In turn, as illustrated in FIGS. 1 and 2, this forces a now rear side portion of the lock structure body 64 into engagement with a facing rear side surface portion of the tooth point opening 12, thereby causing the installed rotary lock structure 10 to exert on the tooth point 20 a continuous resilient force on the tooth point 20 tending to rearwardly tighten it onto the adapter nose.

Second, as the lock structure 10 is rotated, the outer end of the outwardly projecting detent member 68 is slid along the circumferentially ramped adapter nose recess side surface 42 to thereby progressively cam the detent member 68 into the lock structure body bore 90 (see FIG. 6), against the resilient resistance of the detent spring 102, until the detent member circumferentially reaches the adapter nose pocket area 44 at which point the detent member 68 snaps into the pocket area 44 (see FIGS. 1 and 2). This releasably prevents the installed rotary lock structure 10 from rotating back to its initially inserted position (see FIGS. 8 and 9) which, until lock structure removal is intended, would undesirably permit the force exerting member to return to its outwardly projecting relaxed position and thus permit the lock structure 10 to fall out of the tooth and adapter nose openings 12 and 14 and the tooth 20 to fall of the adapter nose 16.

To facilitate removal of the installed rotary lock structure 10, and thereby permit removal and replacement of the tooth point 20, the detent member 68 is preferably of a frangible or shearable construction. As schematically illustrated in FIG. 3, this permits the lock structure body 64 to be axially driven, as indicated by the double-ended arrow 103, relative to the balance of the assembly 22 (with a relatively small force) to shear the detent pin 68 against a generally horizontal vertically facing side surface of the pocket area 44 and permit removal rotation and axial withdrawal of the installed rotary lock structure 10.

Figure 10:
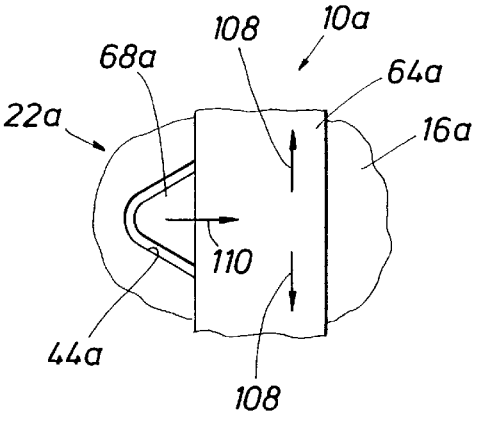
FIGS. 10 and 11 are schematic partial cross-sectional views through alternate embodiments of the excavating tooth/adapter assembly respectively illustrating the inward release camming of a detent pin portion of the installed rotary lock structure in response to axial and rotational driving of the lock structure relative to the balance of the assembly.
Figure 11:
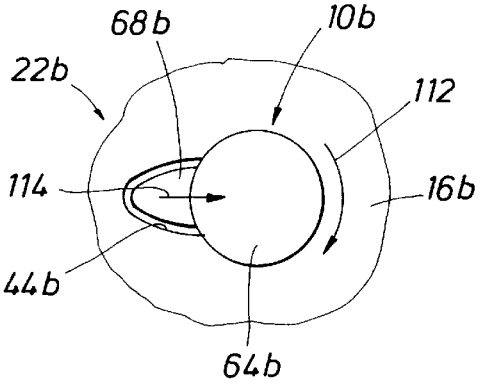

FIGS. 10 and 11, respectively, schematically depict interior cross-sectional portions of alternate embodiments 22*a* and 22*b* of the previously described excavating tooth/adapter assembly 22. In the alternate assembly 22*a* (FIG. 10), the lock structure detent member 68*a* has sloping side surfaces which face similarly sloped vertically facing side surfaces of the adapter nose depression 44*a* which receives the detent member 68*a*. With this detent member/detent pocket configuration the installed lock structure 10*a* may be axially driven upwardly or downwardly, as indicated by the arrows 108 in FIG. 10 to cause the sloped vertically facing surfaces of the pocket 44*a* to cam the detent member 68*a* inwardly (as indicated by the arrow 110) and permit removal rotation and axial withdrawal of the lock structure 10*a*. In the alternate assembly embodiment 10*b* (FIG. 11), the detent member 68*b* also has sloping side surfaces, and the opposite horizontally facing side surfaces of the adapter nose pocket 44*b* are similarly sloped. This permits the body 64*b* of the installed lock structure 10*b* to be forcibly rotated, as indicated by the arrow 112, to thereby cause the sloped, horizontally facing side surfaces of the adapter nose pocket 44*b* to inwardly cam the detent member 64*b*, as indicated by the arrow 114 and permit the lock structure 10*b* to then be axially removed from the balance of the assembly 22*b*.

As can be readily seen from the foregoing, the rotary lock structure 10 provides a variety of advantages over conventional connector structures which have been used in the past to removably hold a tooth point on its associated adapter nose portion. For example, there is no need to drive the lock structure 10 into the tooth and adapter nose openings 12 and 14 to compress the laterally resilient portion of the lock structure. Instead, due to the unique arrangement and configuration of the tooth/adapter opening means 12,14 the lock structure 10 may be simply slipped into the assembly 22 and subsequently rotated (with no pounding force) to exert and maintain the resilient tightening force on the tooth 20.

Additionally, since the force exerting member 66 does not have to be depressed and then caused to snap into a recess during installation of the lock structure, all of the available resilient force associated with the force exerting member 66 may be used to maintain a resilient tightening force on the tooth 20. Furthermore, the resiliently biased force exerting member 66 desirably compensates for operating wear along the adapter nose/tooth pocket surface interface by automatically moving the tooth 20 further rearwardly along the adapter nose 16 in response to such wear. Moreover, retention of the locking structure 10 within the tooth and adapter nose openings 12,14 is not dependent upon the maintenance of a resilient spring force on the force exerting member 66. Instead, the locking structure 10 is provided with an independent structure in the form of the separate detent member 68.

The foregoing detailed description is to be clearly understood as being given by way of illustration and example only, the spirit and scope of the present invention being limited solely by the appended claims.

What is claimed is:

1. Earth working tooth and adapter apparatus comprising:

a replaceable tooth point having a pocket area, an outer wall, and a first opening extending through said outer wall into said pocket area and having a side surface;

an adapter having a forwardly projecting nose portion with a second opening extending therethrough and having a side surface, said nose portion being removably insertable into said pocket area in a manner causing said second opening to underlie said first opening; and a rotary lock structure having a resiliently deflectable force exerting portion and, with said nose portion inserted into said pocket area, being insertable along an insertion axis into said first and second openings in a first rotational orientation and then rotated about said insertion axis to a second rotational orientation, said side surfaces of said first and second openings being configured to resiliently deflect said force exerting portion transversely to said insertion axis, in a manner causing said rotary lock structure to exert on said nose portion and tooth point a resilient force tending to tighten said tooth point rearwardly onto said nose portion, in response to movement of said rotary lock structure from said first rotational orientation to said second rotational orientation within said first and second openings.

2. Earth working tooth and adapter apparatus comprising:

a replaceable tooth point having a pocket area, an outer wall, and a first opening extending through said outer wall into said pocket area and having a side surface;

an adapter having a forwardly projecting nose portion with a second opening extending therethrough and having a side surface, said nose portion being removably insertable into said pocket area in a manner causing said second opening to underlie said first opening; and a rotary lock structure having a resiliently deflectable force exerting portion and, with said nose portion inserted into said pocket area, being insertable along an insertion axis into said first and second openings in a first rotational orientation and then rotated about said insertion axis to a second rotational orientation, said side surfaces of said first and second openings being configured to resiliently deflect said force exerting portion, in a manner causing said rotary lock structure to exert on said nose portion and tooth point a resilient force tending to tighten said tooth point rearwardly onto said nose portion, in response to movement of said rotary lock structure from said first rotational orientation to said second rotational orientation within said first and second openings, said rotary lock structure including a generally cylindrical body portion having a side surface recess configured to movably receive said force exerting portion, and resilient means for resiliently biasing said force exerting portion outwardly through said side surface recess.

3. The earth working tooth and adapter apparatus of claim 2 wherein said resilient means includes a mechanical spring structure at least partially disposed within said side surface recess.

4. Earth working tooth and adapter apparatus comprising:

a replaceable tooth point having a pocket area, an outer wall, and a first opening extending through said outer wall into said pocket area and having a side surface;

an adapter having a forwardly projecting nose portion with a second opening extending therethrough and having a side surface, said nose portion being removably insertable into said pocket area in a manner causing said second opening to underlie said first opening; and a rotary lock structure having a resiliently deflectable force exerting portion and, with said nose portion inserted into said pocket area, being insertable along an insertion axis into said first and second openings in a first rotational orientation and then rotated about said insertion axis to a second rotational orientation, said side surfaces of said first and second openings being configured to resiliently deflect said force exerting portion, in a manner causing said rotary lock structure to exert on said nose portion and tooth point a resilient force tending to tighten said tooth point rearwardly onto said nose portion, in response to movement of said rotary lock structure from said first rotational orientation to said second rotational orientation within said first and second openings, said first opening having a rear side surface area, and said second opening having a front side surface area spaced apart in a front-to-rear direction a first distance from said rear side surface area, and said first and second openings combinatively providing a minimum rotary lock structure insertion width greater than said first distance, said insertion width extending generally transversely to said insertion axis and in a second direction different than said front-to-rear direction.

5. The earth working tooth and adapter apparatus of claim 4 wherein said second direction is generally transverse to said front-to-rear direction.

6. The earth working tooth and adapter apparatus of claim 4 wherein, with said rotary lock structure in said second rotational orientation thereof, (1) said force exerting portion of said rotary lock structure engages and is inwardly deflected by said front side surface area of said second opening, and (2) said rear side surface area of said first opening is forcibly engaged by another portion of said rotary lock structure.

7. Earth working tooth and adapter apparatus comprising:

a replaceable tooth point having a pocket area, an outer wall, and a first opening extending through said outer wall into said pocket area and having a side surface;

an adapter having a forwardly projecting nose portion with a second opening extending therethrough and having a side surface, said nose portion being removably insertable into said pocket area in a manner causing said second opening to underlie said first opening; and a rotary lock structure having a resiliently deflectable force exerting portion and, with said nose portion inserted into said pocket area, being insertable along an insertion axis into said first and second openings in a first rotational orientation and then rotated about said insertion axis to a second rotational orientation, said side surfaces of said first and second openings being configured to resiliently deflect said force exerting portion, in a manner causing said rotary lock structure to exert on said nose portion and tooth point a resilient force tending to tighten said tooth point rearwardly onto said nose portion, in response to movement of said rotary lock structure from said first rotational orientation to said second rotational orientation within said first and second openings, said earth working tooth and adapter apparatus further comprising cooperating structures including a detent pocket area formed in one of said tooth point and said adapter, and a detent member carried on said rotary lock structure and receivable in said detent pocket area in response to movement of said rotary lock structure from said first rotational orientation thereof to said second rotational orientation thereof.

8. The earth working tooth and adapter apparatus of claim 7 wherein:

said rotary lock structure has a cylindrical body portion with an opening extending inwardly through a side surface thereof, said detent member is received in said body portion opening, and said rotary lock structure further includes means for resiliently biasing said detent member outwardly through said body portion opening.

9. The earth working tooth and adapter apparatus of claim 8 wherein:

said adapter nose portion has an exterior side surface recess disposed thereon and having a ramped side surface positioned and configured to inwardly cam said detent member, and then permit said detent member to snap into said detent pocket area, in response to movement of said rotary lock structure from said first rotational orientation thereof to said second rotational orientation thereof.

10. The earth working tooth and adapter apparatus of claim 9 wherein said first opening has an outwardly enlarged peripheral area positioned over a portion of said adapter side surface recess and configured to permit said detent member to move inwardly therethrough into said adapter side surface recess during insertion of said rotary lock structure into said first and second openings.

11. The earth working tooth and adapter apparatus of claim 7 wherein said detent member is of a shearable construction permitting it to be sheared apart by a surface area of said detent pocket area in response to a forced movement of the installed rotary lock structure relative to said earth working tooth point and adapter.

12. The earth working tooth and adapter apparatus of claim 7 wherein:

said detent member is retractable into a portion of said rotary lock structure, and said detent pocket area has a sloped surface positioned and configured to cam said detent member inwardly into said portion of said rotary lock structure in response to a forced movement of said rotary lock structure relative to said earth working tooth point and adapter.

13. A rotary lock structure for use in releasably retaining an excavating tooth point on an adapter nose, said rotary lock structure comprising:

a generally cylindrical body portion having a side surface recess formed therein;

a force exerting member movably received in said side surface recess;

first resilient means for resiliently biasing said force exerting member outwardly through said side surface recess;

an opening extending radially through said body portion;

a detent member movably received in said opening; and second resilient means for resiliently biasing said detent member outwardly through said opening.

14. The rotary lock structure of claim 13 wherein said first resilient means includes a mechanical spring structure at least partially disposed within said side surface recess.

15. The rotary lock structure of claim 13 wherein said second resilient means include a mechanical spring structure disposed within said opening.

16. The rotary lock structure of claim 13 wherein said detent member is on a circumferentially opposite location of said body portion than said side surface recess.

17. The rotary lock structure of claim 13 wherein:

said body portion has first and second opposite ends, said side surface recess is positioned between said first and second ends, and said detent member is positioned between said first end and said side surface recess.

18. The rotary lock structure of claim 17 wherein said first end has a diametrically opposite pair of radially extending depressions formed therein.

19. An earth working structure comprising:

a wall portion having a leading edge section;

a replaceable excavating tooth point having a pocket area, an outer wall, and a first opening extending through said outer wall into said pocket area and having a side surface;

an adapter anchored to said leading edge section of said wall portion and having a forwardly projecting nose portion with a second opening extending therethrough and having a side surface, said nose portion being removably received in said pocket area with said second opening underlying said first opening; and a rotary lock structure received in said first and second openings and removably retaining said tooth point on said adapter nose portion, said rotary lock structure having a resiliently deflectable force exerting portion, being in a second rotational orientation, and exerting on said adapter nose portion and said tooth point a resilient force tending to rearwardly tighten said tooth point onto said adapter nose portion, said side surfaces of said first and second openings being configured to (1) permit insertion of said rotary lock structure thereinto, along an insertion axis, in a first rotational orientation and then be rotated about said insertion axis to said second rotational orientation, and (2) resiliently deflect said force exerting portion transversely to said insertion axis in response to movement of said rotary lock structure from said first rotational orientation within said first and second openings to said second rotational orientation.

20. The earth working structure of claim 19 wherein said earth working structure is an excavating bucket.

21. An earth working structure comprising:

a wall portion having a leading edge section;

a replaceable excavating tooth point having a pocket area, an outer wall, and a first opening extending through said outer wall into said pocket area and having a side surface;

an adapter anchored to said leading edge section of said wall portion and having a forwardly projecting nose portion with a second opening extending therethrough and having a side surface, said nose portion being removably received in said pocket area with said second opening underlying said first opening; and a rotary lock structure received in said first and second openings and removably retaining said tooth point on said adapter nose portion, said rotary lock structure having a resiliently deflectable force exerting portion, being in a second rotational orientation, and exerting on said adapter nose portion and said tooth point a resilient force tending to rearwardly tighten said tooth point onto said adapter nose portion, said side surfaces of said first and second openings being configured to (1) permit insertion of said rotary lock structure thereinto, along an insertion axis, in a first rotational orientation and then be rotated about said insertion axis to said second rotational orientation, and (2) resiliently deflect said force exerting portion in response to movement of said rotary lock structure from said first rotational orientation within said first and second openings to said second rotational orientation, said rotary lock structure including a generally cylindrical body portion having a side surface recess configured to movably receive said force exerting portion, and resilient means for resiliently biasing said force exerting portion outwardly through said side surface recess.

22. The earth working structure of claim 21 wherein said resilient means includes a mechanical spring structure at least partially disposed within said side surface recess.

23. An earth working structure comprising:

a wall portion having a leading edge section;

a replaceable excavating tooth point having a pocket area, an outer wall, and a first opening extending through said outer wall into said pocket area and having a side surface;

an adapter anchored to said leading edge section of said wall portion and having a forwardly projecting nose portion with a second opening extending therethrough and having a side surface, said nose portion being removably received in said pocket area with said second opening underlying said first opening; and a rotary lock structure received in said first and second openings and removably retaining said tooth point on said adapter nose portion, said rotary lock structure having a resiliently deflectable force exerting portion, being in a second rotational orientation, and exerting on said adapter nose portion and said tooth point a resilient force tending to rearwardly tighten said tooth point onto said adapter nose portion, said side surfaces of said first and second openings being configured to (1) permit insertion of said rotary lock structure thereinto, along an insertion axis, in a first rotational orientation and then be rotated about said insertion axis to said second rotational orientation, and (2) resiliently deflect said force exerting portion in response to movement of said rotary lock structure from said first rotational orientation within said first and second openings to said second rotational orientation, said first opening having a rear side surface area, and said second opening having a front side surface area spaced apart in a front-to-rear direction a first distance from said rear side surface area, and said first and second openings combinatively providing a minimum rotary lock structure insertion width greater than said first distance, said insertion width extending generally transversely to said insertion axis and in a direction different than said front-to-rear direction.

24. The earth working structure of claim 23 wherein said insertion width direction is generally transverse to said front-to-rear direction.

25. The earth working structure of claim 23 wherein said force exerting portion of said rotary lock structure engages and is inwardly deflected by said front side surface area of said second opening, and said rear side surface area of said first opening is forcibly engaged by another portion of said rotary lock structure.

26. An earth working structure comprising:

a wall portion having a leading edge section;

a replaceable excavating tooth point having a pocket area, an outer wall, and a first opening extending through said outer wall into said pocket area and having a side surface;

an adapter anchored to said leading edge section of said wall portion and having a forwardly projecting nose portion with a second opening extending therethrough and having a side surface, said nose portion being removably received in said pocket area with said second opening underlying said first opening; and a rotary lock structure received in said first and second openings and removably retaining said tooth point on said adapter nose portion, said rotary lock structure having a resiliently deflectable force exerting portion, being in a second rotational orientation, and exerting on said adapter nose portion and said tooth point a resilient force tending to rearwardly tighten said tooth point onto said adapter nose portion, said side surfaces of said first and second openings being configured to (1) permit insertion of said rotary lock structure thereinto, along an insertion axis, in a first rotational orientation and then be rotated about said insertion axis to said second rotational orientation, and (2) resiliently deflect said force exerting portion in response to movement of said rotary lock structure from said first rotational orientation within said first and second openings to said second rotational orientation, said earth working structure further comprising cooperating structures including a detent pocket area formed in one of said tooth point and said adapter, and a detent member carried on said rotary lock structure and receivable in said detent pocket area in response to movement of said rotary lock structure from said first rotational orientation thereof to said second rotational orientation thereof.

27. The earth working structure of claim 26 wherein:

said rotary lock structure has a cylindrical body portion with an opening extending inwardly through a side surface thereof, said detent member is received in said body portion opening, and said rotary lock structure further includes means for resiliently biasing said detent member outwardly through said body portion opening.

28. The earth working structure of claim 27 wherein:

said adapter nose portion has an exterior side surface recess disposed thereon and having a ramped side surface positioned and configured to inwardly cam said detent member, and then permit said detent member to snap into said detent pocket area, in response to movement of said rotary lock structure from said first rotational orientation thereof to said second rotational orientation thereof.

29. The earth working structure of claim 28 wherein said first opening has an outwardly enlarged peripheral area positioned over a portion of said adapter side surface recess and configured to permit said detent member to move inwardly therethrough into said adapter side surface recess during insertion of said rotary lock structure into said first and second openings.

30. The earth working structure of claim 26 wherein said detent member is of a shearable construction permitting it to be sheared apart by a surface area of said detent pocket area in response to a forced movement of the installed rotary lock structure relative to said earth working tooth point and adapter.

31. The earth working structure of claim 26 wherein:

said detent member is retractable into a portion of said rotary lock structure, and said detent pocket area has a sloped surface positioned and configured to cam said detent member inwardly into said portion of said rotary lock structure in response to a forced movement of said rotary lock structure relative to said earth working tooth point and adapter.

* * * * *